US005547106A

United States Patent [19]

Samonsky

[11] Patent Number: 5,547,106

[45] Date of Patent: Aug. 20, 1996

[54] APPARATUS FOR DISPENSING OBJECTS

[76] Inventor: R. Lynn Samonsky, 211 Wildwood Dr., Belvedere, S.C. 29841

[21] Appl. No.: 293,704

[22] Filed: Aug. 22, 1994

Related U.S. Application Data

[63] Continuation-in-part of Ser. No. 163,878, Dec. 8, 1993, abandoned.

[51] Int. Cl.[6] ..... G07F 11/10

[52] U.S. Cl. ..... 221/193; 221/53; 221/195; 221/268; 221/270; 221/276

[58] Field of Search ..... 221/268, 267, 221/193, 191, 195, 261, 270, 272, 276, 53

[56] References Cited

U.S. PATENT DOCUMENTS

| | | | |
|---|---|---|---|
| 764,818 | 7/1904 | McMillan | 221/276 X |
| 795,891 | 7/1904 | Buck | 221/276 |
| 1,766,297 | 6/1930 | Macke | 221/270 X |
| 1,879,884 | 9/1932 | Rowe | 221/270 X |
| 2,913,143 | 11/1959 | Compton | 221/268 |
| 3,342,373 | 9/1967 | Weitzman | 221/268 X |
| 3,601,237 | 8/1971 | Ovsienko | 221/261 X |
| 5,065,897 | 11/1991 | Smith | 221/270 X |

FOREIGN PATENT DOCUMENTS

| | | | |
|---|---|---|---|
| 2645772 | 4/1978 | Germany | 221/276 X |
| 64353 | 1/1913 | Switzerland | 221/268 X |

*Primary Examiner*—William E. Terrell
*Assistant Examiner*—Dean A. Reichard
*Attorney, Agent, or Firm*—Michael A. Mann, P.A.

[57] ABSTRACT

An apparatus for dispensing objects such as billiard chalk and containers of powder comprises a housing with a front door and two hoppers in it, one hopper for a stack of pairs of chalks and one for a stack of containers of powder, a shelf located below the hoppers, a chute beginning behind the shelf and leading to an access opening in the housing below its front door, and two coin mechanisms in the door of the housing. The coin mechanisms have push rods mounted so that they intercept the selected object when pushed. Placement of coins of the appropriate denomination enables the pushing of the push rods toward the selected object and its pushing from the shelf into the chute.

20 Claims, 3 Drawing Sheets

APPARATUS FOR DISPENSING OBJECTS

This is a continuation-in-part of application Ser. No. 08/163,878, filed on Dec. 8, 1993, now abandoned.

BACKGROUND OF THE INVENTION

1. Field of the Invention

This invention relates to dispensers of objects. More particularly, this invention relates to an apparatus that dispenses billiard chalk and powder.

2. Discussion of Background

Dispensers and vending machines enable the controlled, automatic exchange of goods for legal tender or tokens. Vending machines have revolutionized the distribution of certain consumer products, the more familiar being soft drinks, candy, snack and laundry supply vending machines. Vending machines have increased sales revenue by providing greater access to the product and reducing overhead. They are ideal where many purchasers want only one or two items of an inexpensive kind. In these sales transactions, the cost of the sale would be a significant part of the cost of the item if the items were sold by clerks in stores rather than by machine. But machine sales make the cost of sales affordable and help to keep the cost of the items low. These machines are usually positioned in areas having high foot traffic where space may be too small for a concession stand, or in remote rest areas along interstate highways where transactions are too few to justify a store.

In billiard parlors and pool halls, people of widely varying degrees of skill play pool. The better, more sophisticated players pay close attention to the details of the game: they apply chalk frequently to the ends of their pool cue sticks using fresh chalk; they apply powder or rosin to their hands so that they maintain good control over the cue during a shot. For these players, fresh chalk and powder are part of the necessary equipment needed for the game.

Chalk and powder are usually supplied free by the owner of a pool hall. However, the chalks are frequently worn deeply and will scuff the edges of the tip of the cue stick. The powder (or rosin) is often available in the form of a cone, not always of the best quality or convenient for the user. Providing fresh chalk and fine powder free would be an additional expense to owners of pool halls and one not always appreciated by their many patrons.

SUMMARY OF THE INVENTION

According to its major aspects and broadly stated, the present invention is an apparatus for dispensing objects comprising a housing having an opening, a hopper in the housing for supporting a vertical stack of each object to be dispensed, a shelf in the housing under and spaced apart from the hoppers so that the object at the bottom of the stack falls through the opening in the bottom of the hopper and lands on the shelf where it supports the remaining objects above it in the hopper, a chute that conveys objects pushed from the shelf to the opening of the housing, and push rods for pushing the objects from the shelf.

The apparatus preferably dispenses billiard chalk and powder (or rosin) in containers. The chalks are dispensed two at a time in side-by-side arrangement from the same hopper, pushed from the shelf by a single push rod. The powder hopper has a slot for making it easier to load the hopper.

The cooperation of push rods and the objects to be dispensed is an important feature of the present invention. The push rods are aligned with the top of the shelf, the bottom of the hopper and the first end of the chute so that, when the bottom object is resting on the shelf, just below the hopper, supporting the remaining objects of the stack, the push rod must merely push it off the back edge of the shelf between the shelf and the back of the housing, and the object will fall through the chute to the opening. One or both of the push rods may be configured so that, as the rod returns to its rest position after pushing the bottom object off the shelf, the rod guides the next object onto the shelf and prevents the object from binding or hanging up on any component of the apparatus. This cooperation makes the present device independent of electrical controls, very simple mechanically and unlikely to jam.

The hopper dimensioned for a pair of billiard chalks is another important feature of the present invention. Chalks are stacked in pairs and dispensed in pairs using a single push rod to push them into a chute. The chalk hopper is configured to allow the bottom pair of chalks to be pushed to the rear of the dispenser but not to the sides or front. Because pool players prefer to use two chalks, one at each end or each side of the pool table, dispensing two at a time meets their needs more efficiently than dispensing one at a time.

The slot of the powder hopper is another feature of the present invention. The slot makes it much easier to assure that they are all aligned. As with the chalk hopper, the bottom of the powder hopper is configured to allow the powder container to be pushed to the rear but not to the sides or the front.

To accommodate the relative differences in size between chalks and powder containers, the shelf width may be varied or it may be moved far enough away from the back wall of the dispenser so that both chalk and powder fall freely into the chute. Alignment of the back of the shelf and the back edge of the hoppers is an important feature of the present invention. These features are important in that the requirements for dispensing chalks and powder containers are different, yet the present device anticipates those requirements and accommodates them in ways that are not obvious.

Other features and advantages will be apparent to those skilled in the art from a careful reading of the Detailed Description of a Preferred Embodiment presented below and accompanied by the drawings.

DETAILED DESCRIPTION OF PREFERRED EMBODIMENTS

Figure 1:
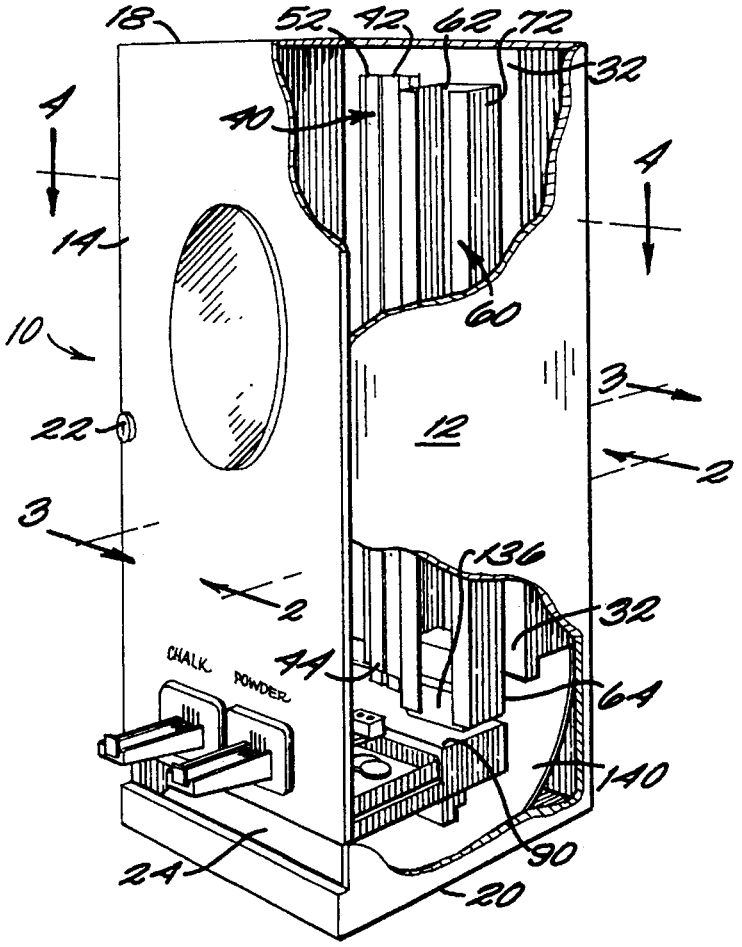
FIG. 1 is a perspective, partially cut-away view of an apparatus for dispensing an object according to a preferred embodiment of the present invention.
Figure 4:
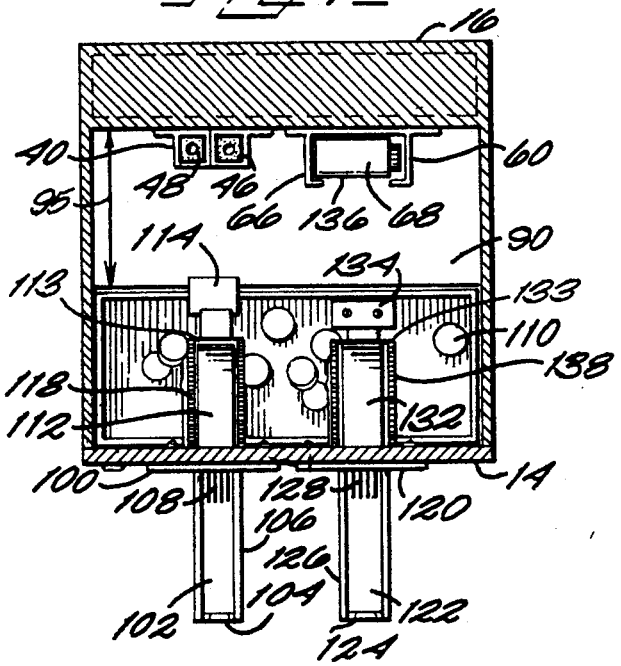
FIG. 4 is a top cross-sectional view of the first hopper and the second hopper in spaced relation to the first pushing means and the second pushing means, along the plane indicated by lines 4—4 of FIG. 1.

In the following description, like reference numerals are intended to identify the same structural elements, portions or surfaces consistently throughout the drawings, as such elements, portions or surfaces may be further described or explained by the entire written specification.

The present invention is an apparatus for dispensing objects such as, in particular, billiard chalk and containers of powder or rosin. It will be clear that the same device may be used to dispense other stackable objects. A stackable object is an item that is reasonably rigid or non-deformable so that any one such item can support the weight of a stack of like items without the weight appreciably affecting the geometry of the bottom object. Preferably, the objects are rectangular solids or generally rectangular solid containers for the dispensed goods so that there are two opposing flat sides to facilitate stacking. The terms "object" and "container" are intended to be broadly construed to include both the container and the object itself, whether in a box, wrapped, covered, or otherwise contained or not.

The objects that will be dispensed by the presently-described apparatus are billiard chalks and powder (or rosin) in containers. The chalks are applied to the ends of cue sticks, and the powder or rosin is applied to the hands of the player to absorb moisture and assure smooth motion of the cue stick against the fingers. Chalks are usually used in pairs, one on each side or end of the pool table.

Referring now to FIGS. 1 through 4, the apparatus, as generally referred to by reference numeral 10, comprises a housing 12, a chalk hopper 40, a powder hopper 60 supported within housing 12, a shelf 90 held within housing 12, and push rods 100 and 120 for pushing an object off shelf 90.

Housing 12 has a rectilinear shape having a height and a depth, a front that has a door 14, a back 16, a top side 18, and a bottom 20. Orienting housing 12 on a horizontal surface such that the horizontal surface is against bottom 20, height is defined as the distance between top 18 and bottom 20, and depth is defined as the distance between door 14 and back 16. In the preferred embodiment, door 14 is hingedly attached to housing 12 and access to the interior of housing 12 is controlled through a lock 22. Furthermore, housing 12 has an opening 24 below door 14 for accessing a dispensed object.

Chalk hopper 40 is held by a panel 32 and has a length and a breadth. Length is defined by the distance between an upper end 42 and a bottom 44, and breadth is defined by the distance between sidewalls 46. Each chalk 48 has a height and a width. Orienting chalk 48 on a horizontal plane, the height of chalk 48 is defined as the distance from the horizontal plane to the uppermost surface, and the width is the distance from the leftmost edge to the rightmost edge. The breadth of chalk hopper 40 is dimensioned to accept the width of each chalk 48 and the length of chalk hopper 40 is dimensioned to hold a plurality of stackable chalks 48.

Bottom 44 of the back of chalk hopper 40 and shelf 90 are spaced apart by a distance equal to the height of each chalk 48. Preferably the front and sides of chalk hopper 40 extend a little farther downwards so that chalk on shelf 90 can be moved only rearwardly. Bottom 44 of chalk hopper 40 has an opening 50 that is dimensioned to pass at least one chalk 48, but preferably two, therethrough, in side-by-side relationship. A plurality of stackable chalks 48 are placed into an opening 52 at upper end 42 of chalk hopper 40. A bottom pair of chalks 48 falls through opening 50 and rests on shelf 90.

Likewise, powder hopper 60 is held by panel 32 and has a length and a breadth. The length of powder hopper 60 is defined by the distance between an upper end 62 and a bottom 64, and the breadth of hopper 60 is defined by the distance between sidewalls 66. Each container 68, which is preferably a container of powder or rosin, has a height and a width. Orienting powder container 68 on a horizontal plane so that the major axis lies from left to right, the height of container 68 is defined as the minor axis, (i.e. the distance from the horizontal plane to the uppermost surface), and the width is the major axis, (i.e. the distance from the leftmost edge to the rightmost edge). The breadth of powder hopper 60 is dimensioned to accept the width of each container 68 and the length of hopper 60 is dimensioned to hold a stack of containers 68.

Bottom 64 of the back of powder hopper 60 and shelf 90 are spaced apart by a distance equal to or slightly greater than the height of each powder container 68. As with chalk hopper 40, the sides and front of powder hopper 60 preferably extend slightly closer to shelf 90 so that powder container 68 can only be moved rearwardly. Bottom 64 of powder hopper 60 has an opening 70 that is dimensioned to pass a powder container 68. A plurality of powder containers 68 are placed into an opening 72 at upper end 62 of powder hopper 60. A bottom powder container 68 falls through opening 70 and rests on shelf 90.

Figure 2:
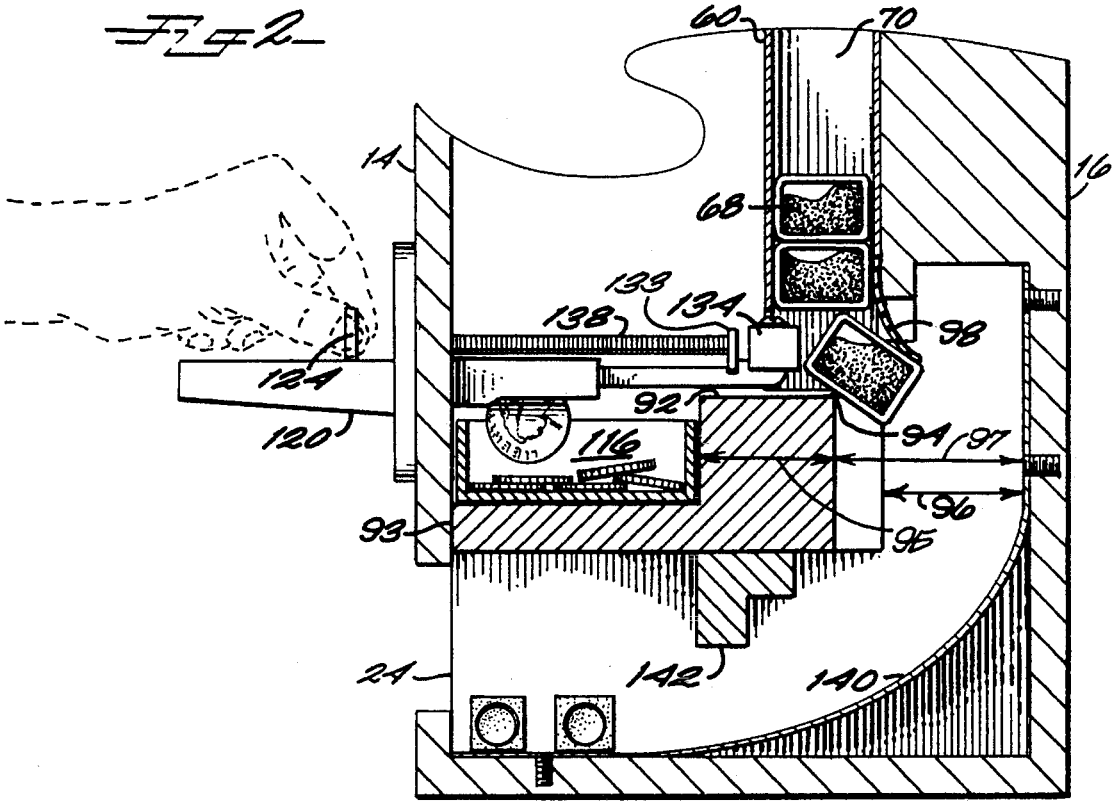
FIG. 2 is a cross-sectional view of the pushing means of FIG. 1 pushing a container of powder off the shelf, along the plane indicated by lines 2—2 of FIG. 1.
Figure 3:
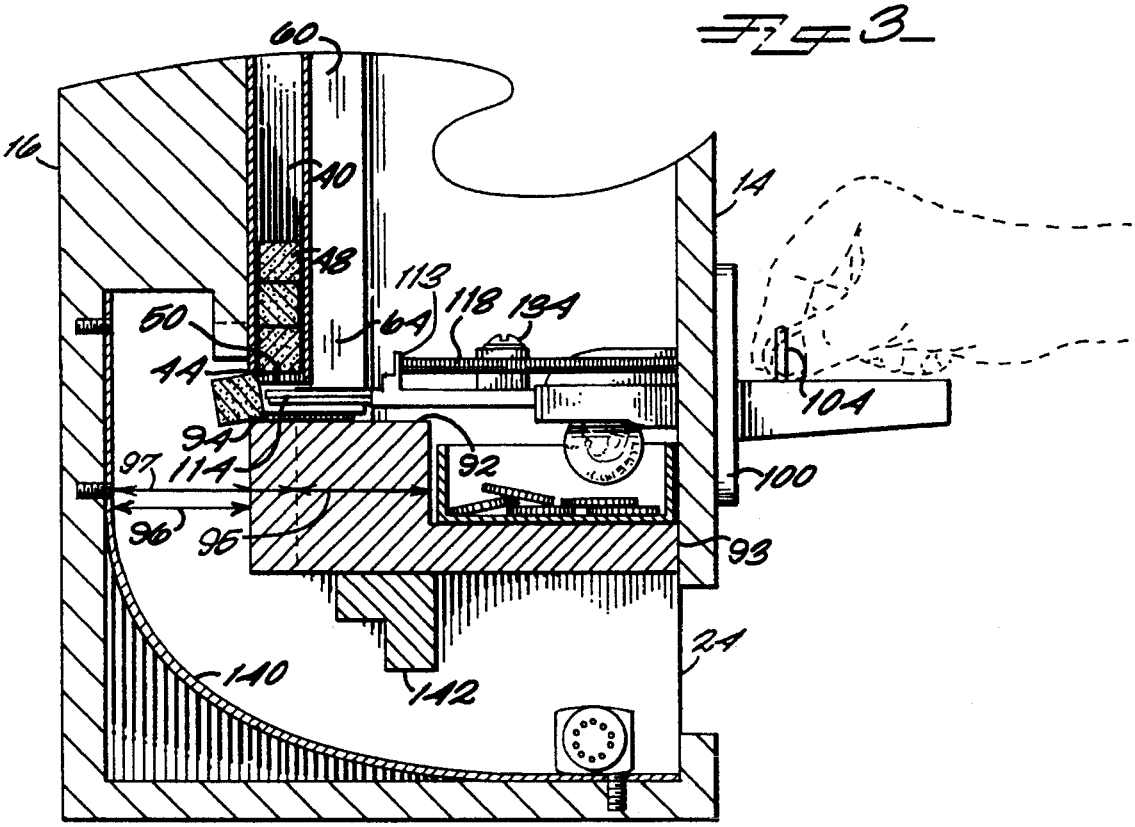
FIG. 3 is a cross-sectional view of the pushing means of FIG. 1 pushing chalk from the shelf, along the plane indicated by lines 3—3 of FIG. 1.

Shelf 90 has an upper surface 92, a front edge 93 and a back edge 94. Back edge 94, as best seen in FIGS. 2 and 3, is spaced apart from back 16 by a distance 96 that may be varied by changing a width 95 to a width 99 of shelf 90 in order to accommodate differently sized objects dispensed from hoppers 40 and 60. For chalks 48 and powder containers 68 as shown, width 95 may be smaller at powder hopper 60 than at chalk hopper 40. Thus, back edge 94 may be spaced apart from back 16 by a distance 96 at chalk hopper 40 and a distance 97 at powder hopper 60, as shown in FIGS. 2 and 3, respectively. Chalks 48 and powder container 68 are pushed between edge 94 and back 16 of housing 12, which together define a first end of a chute 140. Alternatively, shelf 90 may have an approximately constant width 95.

Bottom 64 of hopper 60 has a resilient strip 98 for providing additional resistance to movement of powder container 68 from shelf 90. Strip 98, preferably made of plastic, is attached to bottom 64 of powder hopper 60 and extends to back edge 94 of shelf 90. Strip 98 bends towards back 16 of housing 12 as powder container 68 passes over back edge 94. Powder container 68, unlike chalks 48, is held back briefly by strip 98 until container 68 has been pushed far enough over back edge 94. Container 68 then falls quickly into chute 140.

Powder container 68 and chalks 48 are pushed from shelf 90 separately. Chalks 48 are pushed by a first push rod 100 having a first, palm-engaging side on the exterior of housing 12 and a second, object-engaging side on the interior of housing 12. First push rod 100, and second push rod 120, to be described presently, are coin-unlocked mechanisms having many conventional features of other coin mechanisms but modified for present purposes. The palm-engaging of first push rod 100 has a slideable member 102 having a first edge 104 that is guided within a pair of rails 106, and slots 108 within slideable member 102 where a coin 110 can be deposited. The object-engaging side of push rod 100 has an arm 112 having a first push plate 114 on one end. First push rod 100 is oriented by its attachment on door 14 so that first push plate 114 of arm 112, when in a fully extended position, is held above shelf 90 and is centered under opening 50 of chalk hopper 40.

Likewise, second push rod 120 for powder container 68 has a first, palm-engaging side on the exterior of housing 12 and a second, container-engaging side on the interior of housing 12. The palm-engaging side has a slideable member 122 having a second edge 124 that is guided within a pair of rails 126, and slots 128 within slideable member 122 where a coin 110 can be deposited. The object-engaging side has an arm 132 having a second push plate 134 on one end. Second push rod 120 is oriented on door 14 so that second push plate 134 of arm 132, when in a fully extended position, is held above shelf 90 and centered on a slot 136 formed in powder hopper 60.

First push rod 100 and second push rod 120 each has a rest position and an extended position. First edge 104 of first push rod 100 is shown in the rest position in FIG. 4. Upon the deposit of an appropriate coin 110 in slot 108, first edge 104 is movable towards door 14 so that arm 112 moves toward shelf 90. Arm 112 can then be moved to an extended position between shelf 90 and opening 50 of chalk hopper 40, as seen in FIG. 3. When first push rod 100 is in an extended position, slot 108 is positioned in the interior of housing 12 where coin 110 falls from slot 108 into reservoir 116.

First push plate 114 is moved over upper surface 92 of shelf 90 by the extension of arm 112 where the first push plate pushes the bottom pair of chalks 48 off back edge 94 of upper surface 92 of shelf 90. Arm 112 has a pair of springs 118 (or a single spring) for urging first push rod 100 from the extended position to the rest position. Pair of springs 118 are attached from front side 14 to an end 113 of arm 112. When pair of springs 118 retracts arm 112 to the rest position, a next pair of two chalks 48 from the plurality of stackable chalks 48 fall through opening 50 at bottom 44 of chalk hopper 40 to replace the two removed chalks 48 as the bottom pair of chalks 48.

Likewise, second push rod 120 has a rest position and an extended position. Second edge 124 of second push rod 120, when in the rest position, is in the configuration shown in FIG. 4. Upon the deposit of appropriate coins 110 in slot 128, second edge 124 can be moved towards door 14 so that arm 132 moves towards shelf 90. When arm 132 is extended above shelf 90 and through a slot in powder hopper 60, second push rod 120 is in the extended position as shown in FIG. 2. When second push rod 120 is in the extended position, slot 128 is positioned in the interior of housing 12 where coin 110 falls from slot 128 into reservoir 116.

Second push plate 134 is moved over upper surface 92 of shelf 90 by the extension of arm 132 where second push plate 134 pushes powder container 68 off back edge 94 of upper surface 92 of shelf 90. Arm 132 has a pair of springs 138 (or a single spring) for urging second push rod 120 from the extended position to the rest position. Second push plate 134 pushes powder container 68 through strip 98 and over back edge 94 of shelf 90. Pair of springs 138 are attached from door 14 to an end 133 of arm 132. When pair of springs 138 retracts arm 132 to the rest position, a next powder container 68 from the plurality of stackable powder containers 68 falls through opening 70 at bottom 64 of powder hopper 60 to replace the removed powder container 68.

Back edge 94 of shelf 90 and back 16 of housing 12 have a space therebetween to pass a pair of chalks 48 and a powder container 68. Back 16 of housing 12 has a chute 140 for conveying two chalks 48 and one powder container 68 from shelf 90 to opening 24 of housing 12. An object slides down chute 140 to opening 24 where a patron may withdraw it. An obstruction 142 is mounted within opening 24 to restrict a hand from accessing edge 94 of shelf 90 from opening 24.

Figures 5, 6A, 6B:
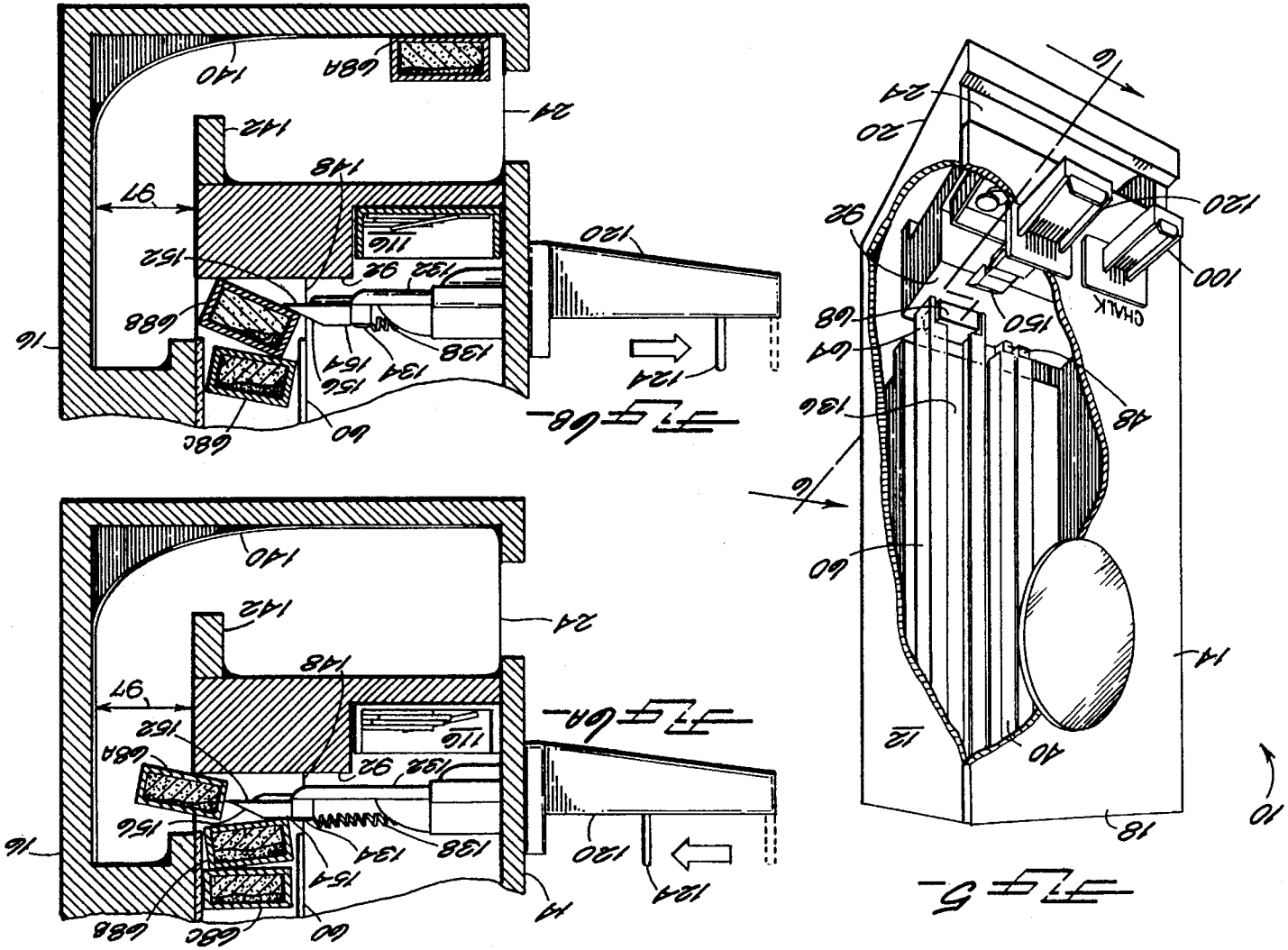
FIG. 5 is a perspective, partially cut-away view of an alternate embodiment of the apparatus of FIG. 1 according to another preferred embodiment of the present invention.
FIG. 6A is a top cross-sectional view of the pushing means of FIG. 5 pushing a container of powder off the shelf, along the plane indicated by lines 6—6 of FIG. 5.
FIG. 6B is a top cross-sectional view of the pushing means of FIG. 5 easing the next container of powder onto the shelf, along the plane indicated by lines 6—6 of FIG. 5.

Referring now to FIGS. 5, 6A and 6B, there is shown an apparatus 10 according to an alternative preferred embodiment of the present invention. As noted above, the front and sides of powder hopper 60 preferably extend downwards, past the top of bottom container 68, so that containers on shelf 90 can be moved only rearwardly. The front of hopper 60 has an opening 148 at bottom 64. Second push plate 134 takes the form of a wedge 150 with a bottom 152, a top 154 and a face 156. Face 156 forms an acute angle with bottom 152, preferably an angle of approximately 45° or less (FIGS. 6A, 6B). Push rod 120 is oriented on door 14 and powder hopper 60 so that bottom 152 is approximately centered on slot 136 and opening 148.

Upon deposit of an appropriate coin or coins, second push rod 120 is movable from a rest position (shown in FIG. 5) to a fully extended and partially extended position (FIGS. 6A, 6B, respectfully). As push rod 120 moves towards its extended position, the tip of wedge 150 engages a bottom powder container 68*a* and pushes the container forwards, and a next container 68*b* settles onto top 154 of wedge 150 (FIG. 6A).

Springs 138 urge rod 120 from the extended position to the rest position, so that arm 132 and wedge 150 retract (FIG. 6B). A next container 68*b* and wedge 150 slide with respect to each other: container 68*b* slides across top 154, then down face 156, so that wedge 150 guides container 68*b* onto upper surface 92 of shelf 90. Container 68*a* slides down chute 140 towards opening 24; a next container 68*b* replaces container 68*a* as the bottom container in hopper 60, to be replaced in turn by container 68*c*. Obstruction 142 prevents the user from accessing shelf 90 from opening 24. Obstruction 142 may take the form shown in FIGS. 2, 3, 6A, 6B, or some other convenient form that restricts access to shelf 90.

Push rod 120, wedge 150, and hopper 60 are configured so that successive containers 68 settle smoothly in place on shelf 90, without binding or hanging up on any component of apparatus 10. The optimum dimensions of wedge 150 depend on the size of opening 148 and the dimensions of containers 68. The tip of wedge 150 preferably engages a container 68 approximately at the center of the container, thus, the height of wedge 150 is approximately one-half the height of the container. The optimum depth of wedge 150, and the angle between bottom 152 and face 156, are such that wedge 150 eases successive powder containers 68 onto shelf 90. Push rod 120 is configured so that, when the rod is in the extended position shown in FIG. 6A, a next bottom container 68*b* drops onto top 154 of wedge 150, without touching springs 138 or other parts of push rod 120.

If desired, first push plate 114 may be configured as a wedge similar to wedge 150, dimensioned according to the dimensions of chalks 48 and chalk hopper 40.

Hoppers 40 and 60 are preferably smooth and true with smooth interior surfaces, so that objects such as chalks 48 and containers 68 move smoothly within the hoppers without hanging up on the interior surfaces thereof. Hoppers 40 and 60 may be made of a plastic material that can readily be machined smooth and true, such as PLEXIGLAS™. However, other materials including wood and metal may be used, as long as the material can be machined to a smooth and true finish.

It will be obvious that many changes and substitutions can be made to the foregoing preferred embodiment described in the foregoing without departing from the spirit and scope of the invention as defined by the following claims.

What is claimed is:

1. An apparatus for dispensing an object, said apparatus comprising:

a housing having an opening;

a hopper carried within said housing and having a bottom, said hopper for holding a plurality of objects in a stack, each object of said plurality of objects having a first end and a second end, said hopper dimensioned for holding pairs of said objects in side-by-side arrangement, each pair of said pairs supporting a remainder of said pairs above it and with a bottom pair of said pairs being at the bottom of said stack, said hopper having an opening at said bottom for passing said bottom pair therethrough;

a shelf carried by said housing and having an upper surface, said upper surface of said shelf spaced apart from and below said bottom of said hopper so that when said bottom pair falls through said opening in said hopper and lands on said shelf, pairs of said objects that have not fallen through said opening are supported by said bottom pair;

a chute formed in said housing for conveying pairs of objects between said upper surface of said shelf and said opening of said housing, said chute dimensioned to pass said pairs therethrough;

means carried by said housing for pushing said bottom pair from said upper surface of said shelf into said chute so that said bottom pair is conveyed by said chute from said upper surface of said shelf to said opening of said housing; and a wedge carried by said pushing means for lowering said first end of said each object of said plurality of objects to said shelf after said second end of said each object of said plurality of objects has fallen into contact with said shelf.

2. The apparatus as recited in claim 1, wherein said hopper is formed to hold said plurality of pairs in a vertical stack, said bottom pair on the bottom of said stack.

3. The apparatus as recited in claim 1, wherein said pushing means further comprises a push rod having a first end and a second end, said first end of said push rod extending outside of said housing and said second end extending inside said housing and carrying a push plate, said push plate having a rest position and an extended position and being aligned to intercept said bottom pair of objects when pushed from said rest position to said extended position, said push plate having a height smaller than the height of said bottom pair so that, when said first end of said push rod is pushed, said push plate engages only said bottom pair and pushes said bottom pair from said shelf and does not push said pairs supported by said bottom pair.

4. The apparatus as recited in claim 1, wherein said pushing means further comprises a push rod having a first end and a second end, said first end of said push rod extending outside of said housing and said second end extending inside said housing and carrying a push plate, said push plate having a rest position and an extended position and being aligned so as to intercept said bottom pair when pushed from said rest position to said extended position, said push plate pushing said bottom pair when in said extended position; and means carried by said housing for urging said push rod to return to said rest position.

5. The apparatus as recited in claim 1, wherein said chute includes means for restricting access to said bottom pair from said opening of said housing when said bottom pair is on said shelf.

6. An apparatus for dispensing objects, said apparatus comprising:

a housing having an opening and a door;

at least one hopper carried within said housing, each hopper of said at least one hopper having a bottom, said each hopper dimensioned for holding a plurality of objects in a vertical stack with a bottom object at the bottom of said stack, each object of said plurality of objects supporting a remainder of said plurality of objects above it, said each object of said plurality of objects having a first end and a second end, said each hopper having an opening at said bottom for passing an object therethrough;

one hopper of said at least one hopper being dimensioned for holding pairs of said objects in side-by-side arrangement in said vertical stack with a bottom pair of objects at said bottom of said stack, said opening in said one hopper being dimensioned to allow said pair to pass therethrough;

a shelf carried by said housing and having an upper surface, said upper surface of said shelf spaced apart from and below said bottom of said each hopper so that objects falling through said opening land on said shelf and objects not having fallen through said opening are supported by said bottom object;

a chute formed in said housing for conveying objects between said upper surface of said shelf and said opening of said housing, said chute dimensioned to pass said objects therethrough;

means carried by said housing for pushing said bottom object and said bottom pair of objects from said upper surface of said shelf into said chute so that said bottom object and said bottom pair of objects are conveyed by said chute from said upper surface of said shelf to said opening of said housing; and a wedge carried by said pushing means for lowering said first end of said each object of said plurality of objects to said shelf after said second end of said each object of said plurality of objects has fallen into contact with said shelf.

7. The apparatus as recited in claim 6, wherein one hopper of said at least one hopper has a slot formed therein for loading said objects.

8. The apparatus as recited in claim 6, wherein said at least one hopper is two hoppers, a chalk hopper dimensioned for dispensing billiard chalk and a powder hopper dimensioned for dispensing powder.

9. The apparatus as recited in claim 6, wherein said pushing means further comprises two push rods, each push rod of said two push rods having a first end and a second end, said first end of said each push rod extending outside of said housing and said second end extending inside said housing and carrying a push plate, said push plate having a height smaller than the height of said bottom object and aligned with one hopper of said at least one hopper so that, when said first end of said push rod is pushed, said push plate engages only said bottom object of said one hopper and pushes said bottom object off said shelf and not said objects supported by said bottom object.

10. The apparatus as recited in claim 6, wherein said pushing means further comprises two push rods, each push rod having a first end and a second end, said first end of said each push rod extending outside of said housing and said second end extending inside said housing and carrying a push plate, said push plate having a rest position and an extended position and being aligned with one hopper of said at least one hoppers so that said push plate pushes said bottom object from said top surface of said shelf when said each push rod is pushed from said rest position to said extended position; and means carried by said housing for urging said each push rod to return to said rest position.

11. The apparatus as recited in claim 6, wherein said bottom object supports a next bottom object above it, and wherein said pushing means further comprises at least one push rod, said push rod having a first end and a second end, said first end extending outside of said housing and said second end extending inside said housing and carrying said wedge, said wedge having a rest position and an extended position and being aligned with one hopper of said at least one hopper so that said wedge pushes said bottom object from said top surface of said shelf when said push rod is pushed from said rest position to said extended position, and when said first end of said push rod is pushed towards said extended position, said wedge engages said bottom object of said one hopper and pushes said bottom object off said shelf, said wedge engaging said next bottom object and guiding said next bottom object onto said shelf as said push rod is returned towards said rest position.

12. The apparatus as recited in claim 6, wherein said chute includes means for restricting access to said bottom object when said bottom object is on said shelf.

13. The apparatus as recited in claim 6, wherein said at least one hopper is two hoppers, a chalk hopper dimensioned for dispensing billiard chalk and a powder hopper dimensioned for dispensing powder, further comprising means carried by said housing for resisting movement of said bottom powder container from said shelf when said pushing means pushes said bottom powder container from said shelf into said chute.

14. An apparatus for dispensing billiard chalk and powder in containers, said apparatus comprising:

a housing having an opening and a door;

a panel carried by said housing;

a chalk hopper carried by said panel and having a bottom, said chalk hopper dimensioned for holding a plurality of pairs of billiard chalks in a vertical array, said chalk hopper having an opening at said bottom dimensioned to enable a bottom pair of billiard chalks to pass therethrough from said chalk hopper;

a powder hopper carried by said panel and having a bottom, said powder hopper dimensioned for holding a plurality of powder containers in a vertical array, each container of said containers having a first end and a second end, said powder hopper having an opening at said bottom dimensioned to enable a bottom powder container to pass therethrough from said powder hopper;

a shelf carried by said housing and having an upper surface, said upper surface of said shelf spaced apart from and below said bottoms of said chalk and powder hoppers so that said bottom pair of billiard chalks and said bottom powder container land on said upper surface of said shelf when falling through said openings of said chalk hopper and said powder hopper, said bottom pair of billiard chalks and said bottom powder container supporting said plurality of pairs of billiard chalks and said plurality of powder containers thereabove respectively;

a chute formed in said housing for conveying pairs of billiard chalks and powder containers between said upper surface of said shelf and said opening of said housing, said chute dimensioned to pass said billiard chalks and powder containers therethrough;

first means carried by said door for pushing said bottom pairs of billiard chalks from said upper surface of said shelf into said chute so that said bottom pair of billiard chalks is conveyed by said chute from said upper surface of said shelf to said opening of said housing;

second means carried by said door for pushing said bottom powder containers from said upper surface of said shelf into said chute so that said bottom powder containers are conveyed by said chute from said upper surface of said shelf to said opening of said housing; and a wedge carried by said second pushing means for lowering said first end of said each container of said plurality of containers to said shelf after said second end of said each container of said plurality of containers has fallen into contact with said shelf.

15. The apparatus as recited in claim 14, wherein said first pushing means further comprises:

a first push rod having a first end and a second end, said first end of said first push rod extending outside of said housing and said second end extending inside said housing and carrying a first push plate, said first push plate having a rest position and an extended position and being aligned with said chalk hopper so that said first push plate pushes said bottom pair of billiard chalks from said top surface of said shelf when said first push rod is pushed from said rest position to said extended position; and means carried by said door for urging said first push rod to return to said rest position, and said second pushing means further comprises:

a second push rod having a first end and a second end, said first end of said second push rod extending outside of said housing and said second end extending inside said housing and carrying a second push plate, said second push plate having a rest position and an extended position and being aligned with said powder hopper so that said second push plate pushes said bottom powder container from said top surface of said shelf when said second push rod is pushed from said rest position to said extended position; and means carried by said door for urging said second push rod to return to said rest position.

16. The apparatus as recited in claim 14, wherein said first pushing means further comprises:

a first push rod having a first end and a second end, said first end of said first push rod extending outside of said housing and said second end extending inside said housing and carrying a first push plate, said first push rod having a rest position and an extended position, said first push plate being aligned with said chalk hopper so that said first push plate pushes said bottom pair of billiard chalks from said top surface of said shelf when said first push rod is pushed from said rest position to said extended position; and said second pushing means further comprises:

a second push rod having a first end and a second end, said first end of said second push rod extending outside of said housing and said second end extending inside said housing and carrying said wedge, said wedge having a rest position and an extended position and being aligned with said powder hopper so that said wedge pushes said bottom powder container from said top surface of said shelf when said second push rod is pushed from said rest position to said extended position, and when said first end of said second push rod is pushed towards said extended position, said wedge engages said bottom powder container and pushes said bottom container off said shelf, said wedge engaging a next bottom powder container and guiding said next container onto said shelf as said second push rod is returned towards said rest position.

17. The apparatus as recited in claim 14, wherein said panel has a bottom edge, and said bottoms of said chalk hopper and powder hopper terminate with said bottom edge of said panel.

18. The apparatus as recited in claim 14, wherein said shelf has a back edge and a front edge, said upper surface of said shelf having a width defined by said front and said back edge, and said housing has a back, said chute having a first end adjacent to said shelf and a second end at said opening of said housing, said back edge of said shelf being spaced apart from said back by a distance, said back and said back edge of said shelf defining said first end of said chute, said width of said shelf being narrower at said powder hopper than at said chalk hopper so that said bottom powder container can pass into and through said first end of said chute between said back edge of said shelf and said back of said housing.

19. The apparatus as recited in claim 14, wherein said powder hopper has a slot formed therein for loading said hopper with powder containers.

20. The apparatus as recited in claim 14, wherein said panel has means carried thereon for resisting movement of said bottom powder container from said shelf when said second pushing means pushes said bottom powder container from said shelf into said chute.

* * * * *